US012687343B2

(12) United States Patent
Nielsen

(10) Patent No.: US 12,687,343 B2
(45) Date of Patent: Jul. 21, 2026

(54) DOUBLE PLATE HEAT EXCHANGER

(71) Applicant: Danfoss A/S, Nordborg (DK)

(72) Inventor: Helge Nielsen, Sydals (DK)

(73) Assignee: DANFOSS A/S, Nordborg (DK)

( * ) Notice: Subject to any disclaimer, the term of this patent is extended or adjusted under 35 U.S.C. 154(b) by 225 days.

(21) Appl. No.: 18/065,379

(22) Filed: Dec. 13, 2022

(65) Prior Publication Data

US 2023/0194183 A1 Jun. 22, 2023

(30) Foreign Application Priority Data

Dec. 16, 2021 (DK) ..... PA202170626

(51) Int. Cl.
*F28D 9/00* (2006.01)
*F28F 3/04* (2006.01)
(Continued)

(52) U.S. Cl.
CPC ..... *F28D 9/0037* (2013.01); *F28D 9/005* (2013.01); *F28F 3/046* (2013.01); *F28F 21/06* (2013.01); *F28F 21/08* (2013.01)

(58) Field of Classification Search
CPC .... F28D 1/0325; F28D 1/0333; F28D 9/0037; F28D 9/005; F28D 9/0043; F28D 9/0031;
(Continued)

(56) References Cited

U.S. PATENT DOCUMENTS 2,617,634 A * 11/1952 Jendrassik ..... F28D 9/0093 165/157
4,002,201 A * 1/1977 Donaldson ..... F28F 3/04 165/166
(Continued)

FOREIGN PATENT DOCUMENTS

CN 107167005 A 9/2017
CN 213778726 U 7/2021
(Continued)

OTHER PUBLICATIONS

Extended European Search Report for corresponding European Patent Application No. 22214234.1 dated May 19, 2023.
(Continued)

*Primary Examiner* — Jianying C Atkisson
*Assistant Examiner* — For K Ling
(74) *Attorney, Agent, or Firm* — McCormick, Paulding & Huber PLLC

(57) ABSTRACT

The present invention relates to a plate element (2) having a first heat transfer plate (10) and a second heat transfer plate (20), the first heat transfer plate (10) and the second heat transfer plate (20) being connected to each other to form the plate element (2). Each of the first heat transfer plate (10) and the second heat transfer plate (20) is formed of a plate body with a main part with a heat exchanging portion (40) formed with a surface pattern (45). The first heat transfer plate (10) is formed with a first set of openings (3*a*, 3*d*) in first extension sections (50) reaching out from the main part of the plate body, and the second heat transfer plate (20) is formed with a second set of openings (3*b*, 3*c*) in second extension sections (50) reaching out from the main part of the plate body. The first extension sections (50) of the first heat transfer plate (10) and the second extension sections (50) of the second heat transfer plate (20) are positioned such that the first set of openings (3*a*, 3*d*) and the second set of openings (3*b*, 3*c*) are not overlapping. The present invention further relates to a plate heat exchanger (1).

17 Claims, 7 Drawing Sheets

(51) Int. Cl.
*F28F 21/06* (2006.01)
*F28F 21/08* (2006.01)

(58) Field of Classification Search
CPC .. F28F 3/046; F28F 3/044; F28F 3/086; F28F 3/005
See application file for complete search history.

(56) References Cited

U.S. PATENT DOCUMENTS 4,246,961 A * 1/1981 Chaix ..... F28D 9/0075 165/145
4,246,962 A * 1/1981 Norback ..... F24F 3/147 165/166
5,178,207 A * 1/1993 Bergqvist ..... F28F 3/005 165/70
5,443,115 A 8/1995 Pedersen et al.
5,472,738 A * 12/1995 Novak ..... F28F 19/04 427/255.6
5,487,424 A * 1/1996 Davison ..... F28F 3/005 165/70
5,884,696 A * 3/1999 Loup ..... F28D 1/0333 165/42
5,913,361 A 6/1999 Engstrom et al.
6,662,862 B1 * 12/2003 Lindholm ..... F28D 9/005 165/70
6,817,406 B1 * 11/2004 Inoue ..... F28F 9/0221 261/DIG. 11
9,175,886 B2 11/2015 Oh et al.
9,897,389 B2 * 2/2018 Denoual ..... F28D 9/0056
2007/0169916 A1 * 7/2007 Wand ..... F28F 3/046 165/70
2011/0083833 A1 4/2011 Zorzin et al.
2011/0155567 A1 6/2011 Sim et al.
2016/0040943 A1 * 2/2016 Han ..... F28D 9/005 165/157
2016/0265852 A1 * 9/2016 Kalbacher ..... F02B 29/0437
2018/0112935 A1 4/2018 Seo

FOREIGN PATENT DOCUMENTS

DE 43 13 351 A1 10/1994
DE 102010015212 A1 * 11/2010 ..... F28D 9/005
DE 10 2009 034 752 A1 2/2011
EP 1 811 255 A2 7/2007
EP 3677863 A1 * 7/2020 ..... F28D 9/0031
EP 3 819 582 A1 5/2021
EP 4 012 070 A1 6/2022
WO 2018/019182 A1 2/2018
WO 2021/154151 A1 8/2021

OTHER PUBLICATIONS

Search Report for corresponding Danish Patent Application No. Pa 2021 70626 dated May 30, 2022.

* cited by examiner

DOUBLE PLATE HEAT EXCHANGER

CROSS-REFERENCE TO RELATED APPLICATION

This application claims foreign priority benefits under 35 U.S.C. § 119 from Danish Patent Application No. PA202170626, filed Dec. 16, 2021, the content of which is hereby incorporated by reference in its entirety.

TECHNICAL FIELD

The present invention relates to plate heat exchangers of the kind having double plates. More specifically the present invention relates to double plate heat exchangers in which a leak in the opening areas does not lead to mixing of fluids.

BACKGROUND

A plate heat exchanger exchanges heat between two or more fluids. In most plate heat exchangers, several stacked plate elements separate the fluids, each plate element having a central heat transferring part and a surrounding edge part. Sometimes particular care must be taken to avoid one heat exchanging fluid from leaking into the flow way of another heat exchanging fluid. This is, e.g., the case in heat exchangers which are used for heating or cooling potable fluids using non-potable fluids, in heat exchangers used for processing critical fluids, and in heat exchangers in which mixing of the two fluids would result in undesired chemical reactions. In these cases, a heat exchanger of the double wall type is normally used. In double wall heat exchangers, the plate elements separating the heat exchanging fluids each comprises two plates which are joined together. The opening areas are, however, still a critical part, since the area between the two plates of the double plate construction may lead fluid to the openings. The problem is especially severe for heat exchangers being subject to high pressure levels.

SUMMARY

It is an object of embodiments of the invention to provide a plate element for a plate heat exchanger in which the risk of leaking between the flow paths of the plate heat exchanger is reduced as compared to prior art plate heat exchangers.

It is a further object of embodiments of the invention to provide a plate heat exchanger in which the risk of leaking between the flow paths of the plate heat exchanger is reduced as compared to prior art plate heat exchangers.

According to a first aspect the invention provides a plate element comprising a first heat transfer plate and a second heat transfer plate, the first heat transfer plate and the second heat transfer plate being connected to each other to form the plate element, each of the first heat transfer plate and the second heat transfer plate being formed of a plate body with a main part with a heat exchanging portion formed with a surface pattern, wherein the first heat transfer plate is formed with a first set of openings in first extension sections reaching out from the main part of the plate body, and the second heat transfer plate is formed with a second set of openings in second extension sections reaching out from the main part of the plate body, wherein the first extension sections of the first heat transfer plate and the second extension sections of the second heat transfer plate are positioned such that the first set of openings and the second set of openings are not overlapping.

Thus, according to the first aspect, the invention provides a plate element comprising a first heat transfer plate and a second heat transfer plate, the first and second heat transfer plates being connected to each other to form the plate element. Accordingly, the plate element is of a double plate type.

The first heat transfer plate as well as the second heat transfer plate is formed of a plate body with a main part with a heat exchanging portion formed with a surface pattern. Thus, when the plate element, comprising the first and second heat transfer plates, forms part of a heat exchanger, heat exchange takes place across the plate element, in a region corresponding to the heat exchanging portions defined by the heat transfer plates.

The first heat transfer plate is formed with a first set of openings. The first set of openings are formed in first extension sections of the first heat transfer plate, and the first extension sections reach out from the main part of the plate body. Accordingly, the first extension sections do not form part of the main part of the plate body, and thereby of the patterned heat exchanging portion of the first heat transfer plate. Thus, the openings of the first set of openings are formed in a part of the first heat transfer plate which is not involved in the heat transfer across the plate element.

Similarly, the second heat transfer plate is formed with a second set of opening in second extension sections reaching out from the main part of the plate body of the second heat transfer plate. The remarks set forth above regarding the first set of openings formed in first heat transfer plate are equally applicable here.

The first extension sections of the first heat transfer plate and the second extension sections of the second heat transfer plate are positioned such that the first set of openings and the second set of openings are not overlapping. Accordingly, when the first heat transfer plate and the second heat transfer plate are connected in order to form the plate element, this is done in such a manner that there is no overlap between the first set of openings, i.e. the openings formed in the first heat transfer plate, and the second set of openings, i.e. the openings formed in the second heat transfer plate. This could, e.g., be obtained by ensuring that there is no overlap between the first extension sections, forming part of the first heat transfer plate, and the second extension sections, forming part of the second heat transfer plate.

This construction of the plate element efficiently enables a separation of fluid flow paths passing through the first set of openings and fluid flow paths passing through the second set of openings. This significantly reduces the risk of fluid leaking between the flow paths, and thereby of mixing of the heat exchanging fluids.

The surface patterns of the respective first heat transfer plate and second heat transfer plate may be formed such that they match each other, such that the surface pattern of one plate fits into the surface pattern of the other plate, thereby together appearing as a single surface pattern of the plate element.

According to this embodiment, the pattern formed in the heat exchanging portion of the first heat transfer plate matches the pattern formed in the heat exchanging portion of the second heat transfer plate, in the sense that hills and valleys of one pattern coincides with hills and valleys of the other pattern. Thereby the plate element appears as having one single surface pattern, and the distance from one side of the plate element to an opposite side of the plate element is minimised across the entire heat exchanging portion. Accordingly, at any given position on the heat exchanging portion, the distance through the plate element is minimal, ideally corresponding to the sum of the thickness of the first heat transfer plate and the thickness of the second heat transfer plate. This ensures an efficient heat transfer through the plate element across the entire area of the heat exchanging portion. Furthermore, this allows the plate element to be applied in a heat exchanger in a manner similar to a traditional single heat transfer plate.

The first heat transfer plate and the second heat transfer plate may be identical, and the second heat transfer plate may be rotated 180° relative to the first heat transfer plate around a centre axis extending along a length direction of the plate element.

According to this embodiment, the heat transfer plates are identical. However, when the heat transfer plates are connected to each other in order to form the plate element, one of the heat transfer plates is rotated 180° relative to the other heat transfer plate around a longitudinal centre axis defined by the plate element. Thus, the heat transfer plates may be regarded as comprising a first side and a second, opposite, side. When the heat transfer plates are connected to form the plate element, the first side of the first heat transfer plate faces the first side of the second heat transfer plate, and the second sides of the first and second heat transfer plates form the outer surfaces of the plate element.

By applying identical heat transfer plates, it is obtained that fewer different parts are required for manufacturing the plate element and a heat exchanger comprising a stack of such plate elements. This reduces the manufacturing costs and allows for simple and easy manufacture.

One of the first set of openings may be formed in an extension section arranged at one end of the first heat transfer plate, and the other of the first set of openings may be formed in an extension section arranged at another, oppositely arranged, end of the first heat transfer plate, along a line being parallel to a long edge of the first heat transfer plate.

According to this embodiment, the openings of the first set of openings are arranged at opposite ends of the first heat transfer plate, along the direction of the long edge thereof. Thereby a flow path can be defined along one side of the first heat transfer plate with an inlet defined by one of the openings of the first set of openings and an outlet defined by the other of the openings of the first set of openings. The flow path defined in this manner will extend along the entire length of the first heat transfer plate.

The oppositely arranged extension sections of the first heat transfer plate may be positioned directly opposite each other along the line being parallel to the long edge of the first heat transfer plate. According to this embodiment, the flow path defined along the side of the first heat transfer plate extends substantially parallel to the long edge of the first heat transfer plate.

As an alternative, the oppositely arranged extension sections of the first heat transfer plate may be positioned at diagonally opposite corners of the first heat transfer plate. According to this embodiment, the flow path defined along the side of the first heat transfer plate extends substantially diagonally along the first heat transfer plate.

Similarly, one of the second set of openings may be formed in an extension section arranged at one end of the second heat transfer plate, and the other of the second set of openings may be formed in an extension section arranged at another, oppositely arranged, end of the second heat transfer plate, along a line parallel to a long edge of the second heat transfer plate. The remarks set forth above with reference to the first heat transfer plate are equally applicable here.

In particular, the oppositely arranged extension sections of the second heat transfer plate may be positioned directly opposite each other along the line being parallel to the long edge of the second heat transfer plate, or, alternatively, the oppositely arranged extension sections of the second heat transfer plate may be positioned at diagonally opposite corners of the second heat transfer plate.

The first heat transfer plate may be made from a first material, and the second heat transfer plate may be made from a second material, wherein the second material differs from the first material.

According to this embodiment, the material of the first heat transfer plate and the material of the second heat transfer plate, respectively, may be selected independently of each other in order to meet various requirements. For instance, if the heat exchanging fluid flowing along the first heat transfer plate is highly corrosive, but the fluid flowing along the second heat transfer plate is not, a material which is very corrosive resistant may be selected for the first heat transfer plate. However, the material for the second heat transfer plate need not be particularly corrosive resistant, and therefore a material may be selected which meets other requirements, such as requirements related to strength, durability, heat conductance, cost, availability, etc.

For instance, the first material may be a metal and the second material may be a plastic material. The metal could, e.g., be steel, such as stainless steel, S316L, S904L, AL201 or other heat transferring materials which are normally applied in heat exchangers. The plastic material could, e.g., be a thermoplastic or a thermo-hardening plastic, with or without fibres of various types. Metals, such as stainless steel, are known to provide high strength and stability. On the other hand, some plastic materials, such as thermoplastics or thermo-hardening plastics, are known to be corrosive resistant as well as to have high heat transfer capability. Thus, by manufacturing the first heat transfer plate from a metal, such as stainless steel, and the second heat transfer plate from a plastic material, such as a thermoplastic or a thermo-hardening plastic, the resulting plate element will have the strength and stability provided by the metal of the first heat transfer plate, as well as the corrosive resistance and heat transfer capability provided by the plastic material of the second heat transfer plate.

According to a second aspect the invention provides a heat exchanger comprising two or more stacked plate elements according to the first aspect of the invention, thereby forming a first flow path along one side of a given plate element and along a connected first neighbouring plate element, between an inlet of the first set of openings and an outlet of the first set of openings, and forming a second flow path along an opposite side of the plate element and along a connected second neighbouring plate element, between an inlet of the second set of openings and an outlet of the second set of openings.

Thus, according to the second aspect the invention provides a heat exchanger comprising two or more stacked plate elements according to the first aspect of the invention, i.e. plate elements of the kind described above. Accordingly, the remarks set forth above with reference to the first aspect of the invention are equally applicable here.

The heat exchanger according to the second aspect of the invention is, thus, a plate heat exchanger, and the stacked plate elements form the heat transferring plates of the heat exchanger.

When the plate elements are stacked to form the heat exchanger, flow paths are formed between respective neighbouring plate elements, and fluid flowing in a given flow path is in thermal contact with both of the plate elements forming the flow path there between. Thus, for a given plate element, a first flow path is formed along one side of the plate element and a second flow path is formed along an opposite side of the plate element. Heat exchange takes place between fluid flowing in the first flow path and fluid flowing in the second flow path, via the heat exchanging portion defined by the heat transfer plates of the plate element.

The first flow path extends between an inlet and an outlet, respectively, in the form of the openings of the first set of openings, i.e. the openings formed in the extension sections of the first heat transfer plate. Similarly, the second flow path extends between an inlet and an outlet, respectively, in the form of the openings of the second set of openings, i.e. the openings formed in the extension sections of the second heat transfer plate. Accordingly, the first flow path is only in contact with the openings formed in the first heat transfer plate, and the second flow path is only in contact with the openings formed in the second heat transfer plate. Since the openings of the first set of openings and the openings of the second set of openings are non-overlapping, this efficiently ensures that the first flow path and the second flow path are separated, thereby efficiently preventing leaking between the first and second flow path and mixing of the heat exchanging fluids.

The plate elements may be stacked in such a manner that the first heat transfer plate of a given plate element is arranged adjacent to the first heat transfer plate of a first neighbouring plate element, and the second heat transfer plate of the given plate element is arranged adjacent to the second heat transfer plate of a second neighbouring plate element.

According to this embodiment, heat transfer plates of the same kind face each other and form flow paths there between. This is in particular an advantage in the case that the material of the first heat transfer plate differs from the material of the second heat transfer plate, because in this case a given flow path will have walls made from the same material. This would, e.g., allow a highly corrosive material to flow in one of the flow paths, without requiring that the walls of the other flow paths are made from a corrosive resistant material.

The plate elements may be stacked in such a manner that connecting rims of the second heat transfer plates of the plate elements are sandwiched between portions of two first heat transfer plates of the plate elements, the portions of the two first heat transfer plates facing an inner formed between the extension sections of the two first heat transfer plates.

Similarly, the plate elements may be stacked in such a manner that connecting rims of the first heat transfer plates of the plate elements are sandwiched between portions of two second heat transfer plates of the plate elements, the portions of the two second heat transfer plates facing an inner formed between the extension sections of the two second heat transfer plates.

This construction ensures that no flow path is formed within a given plate element between the first heat transfer plate and the second heat transfer plate between the openings formed in the respective heat transfer plates. In the case of a fluid leak in the region of one of the openings, the fluid will leak into the area or region between the heat transfer plates, rather than into the other flow path.

Connected first heat transfer plates and connected second heat transfer plates of neighbouring plate elements may be sealed at the circumference of the respective openings, thereby separating them from the inner formed between the respective extension sections of the heat transfer plates.

According to this embodiment, it is efficiently ensured that fluid leaking from one of the openings and entering the volume between two heat transfer plates of neighbouring plate elements leaks into the inner formed between the extension sections, rather than into the other flow path.

The extension sections of the first heat transfer plates of the plate elements may be positioned such that the respective first sets of openings are aligned, and the extension sections of the second heat transfer plates of the plate elements may be positioned such that the respective second sets of openings are aligned.

According to this embodiment, the openings being connected to the first flow path are aligned and the openings being connected to the second flow path are aligned. Thereby fluid flows of the respective heat transferring fluids can easily be supplied to the correct flow paths. This ensures that the two heat transferring fluids are efficiently separated.

DETAILED DESCRIPTION

The detailed description and specific examples, while indicating embodiments of the invention, are given by way of illustration only.

Figure 1:
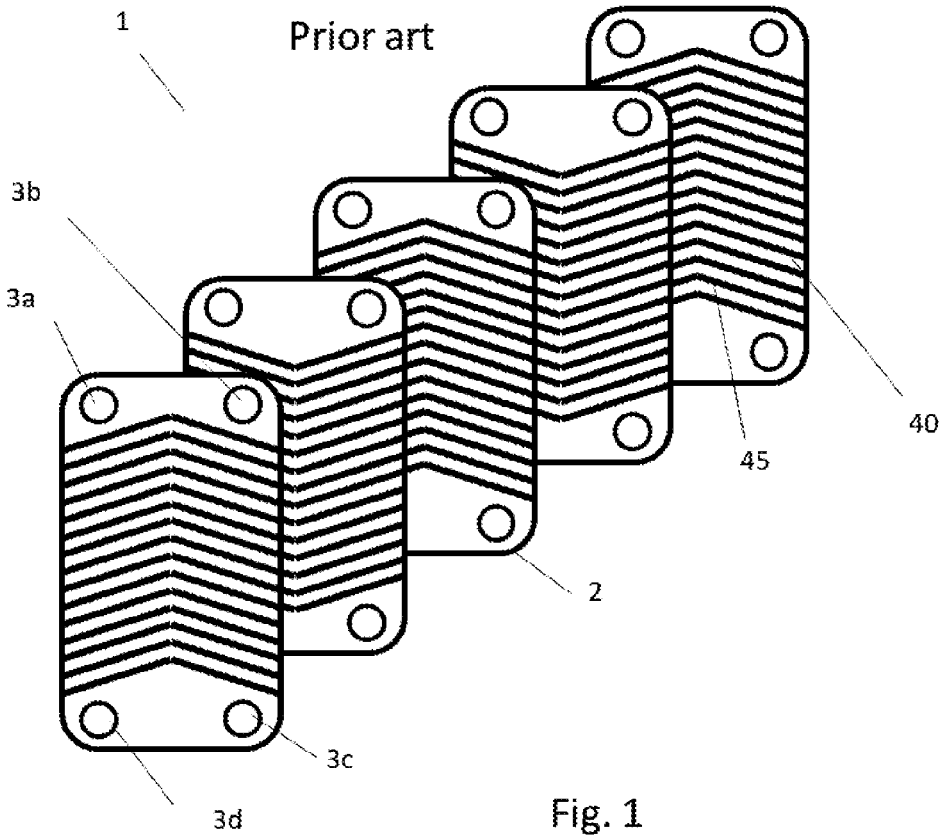
FIG. 1 is a general illustration of the principle of a plate kind heat exchanger according to prior art.

FIG. 1 illustrates a prior art heat exchanger 1 formed of plate elements 2 connected to neighbouring plate elements 2. Each plate element 2 is formed with openings 3*a*, 3*b*, 3*c*, 3*b* and a heat exchanging portion 40 with surface patterns 45. When stacked, the connected surface patterns 45 of neighbouring plate elements 2 form flow paths A, B at the respective opposite surfaces of the plate elements 2, a first flow path A at one surface and a second flow path B at the opposite surface, each passing the heat exchanging portion 40 from an inlet to an outlet opening 3*a*, 3*b*, 3*c*, 3*b*. Further, the openings 3*a*, 3*b*, 3*c*, 3*b* are aligned forming respectively a first set of openings 3*a*, 3*d* defining an inlet and outlet to a first flow path A, and a second set of openings 3*b*, 3*c* defining an inlet and outlet 3*b*, 3*c* to a second flow path B. The first set of openings 3*a*, 3*d* and first flow path A are sealed from the second set of openings 3*b*, 3*c* and second flow path B, allowing two fluids to pass through the heat exchanger 1 without the two fluids contacting and mixing. The heat exchanger 1 is adapted for heat to be transferring from the hotter to the colder of the fluids flowing in the flow paths A, B over the plate elements 2.

Figure 2:
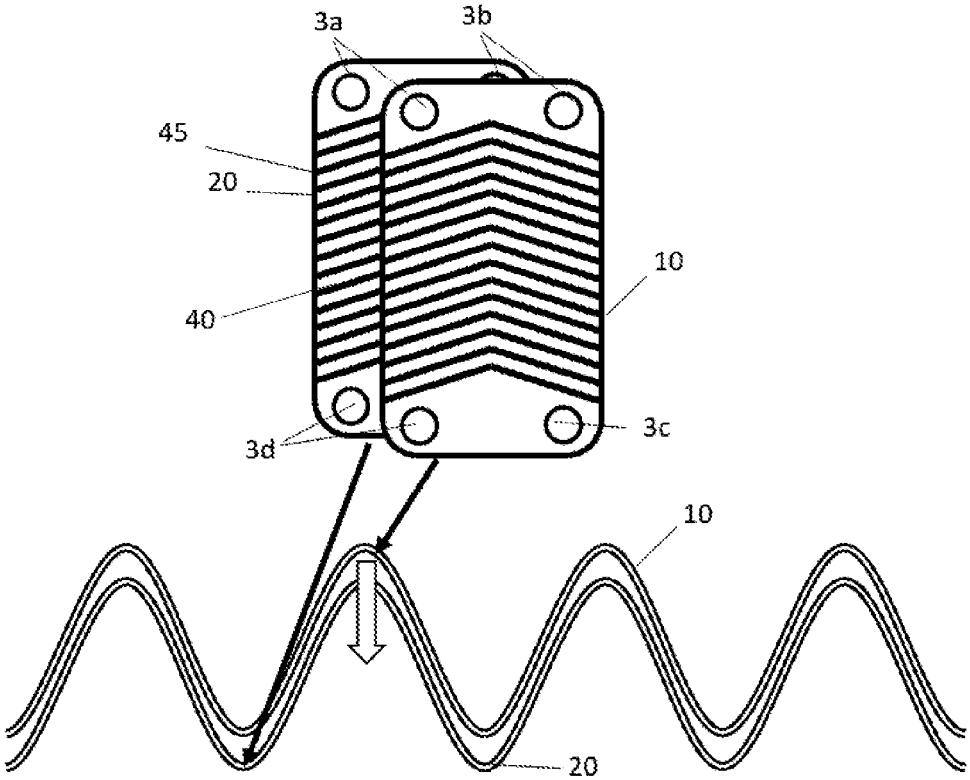
Prior art Fig. 2
FIG. 2 is a general illustration of the principle of a double plate for a heat exchanger according to prior art.

The plate elements 2 are of a double wall construction, see FIG. 2, comprising a first heat transfer plate 10 and a second heat transfer plate 20, each comprising a main part including at least the main portion of a central heat exchanging portion 40 provided with surface patterns 45. The first heat transfer plate 10 and the second heat transfer plate 20 are connected over most of their extension, such as at the central heat exchanging portion 40. If one of the heat transfer plates 10, 20 should fail, e.g. by forming cracks, the other will ensure that the fluids will not leak between the first flow path A and the second flow path B. The first heat transfer plate 10 and the second heat transfer plate 20 may not be tightly contacting over the full extension of the plates 10, 20, and the leaking fluid thus could flow into the volume between the two heat transfer plates 10, 20.

The surface patterns 45 of the respective first heat transfer plate 10 and second heat transfer plate 20 are formed such that they match each other, such that the surface pattern 45 of one plate 10, 20 fits into the surface pattern 45 of the other plate 20, 10, together appearing as a single surface pattern 45 of the plate element 2.

The surface pattern 45 of the plate element 2 is formed such that if a similar plate element 2, possible turned 180° around an axis through the centre of the plate element 2 in a length direction, then the contacting surface patterns 45 form respectively the first flow path A at the one side of the plate element 2, and the second flow path B at the opposite side of the plate element 2, relative to the first side.

Each of the plate elements 2 is formed with a first set of openings 3*a*, 3*d* as well as a second set of openings 3*b*, 3*c*. This introduces a risk of fluid leaking from the first flow path A or the second flow path B to the wrong of the first set of openings 3*a*, 3*d* or the second set of openings 3*b*, 3*c*. For example, fluid entering the volume between the two heat transfer plates 10, 20 of a plate element 2 may leak into the wrong of the first set of openings 3*a*, 3*d* or the second set of openings 3*b*, 3*c*.

Figure 3:
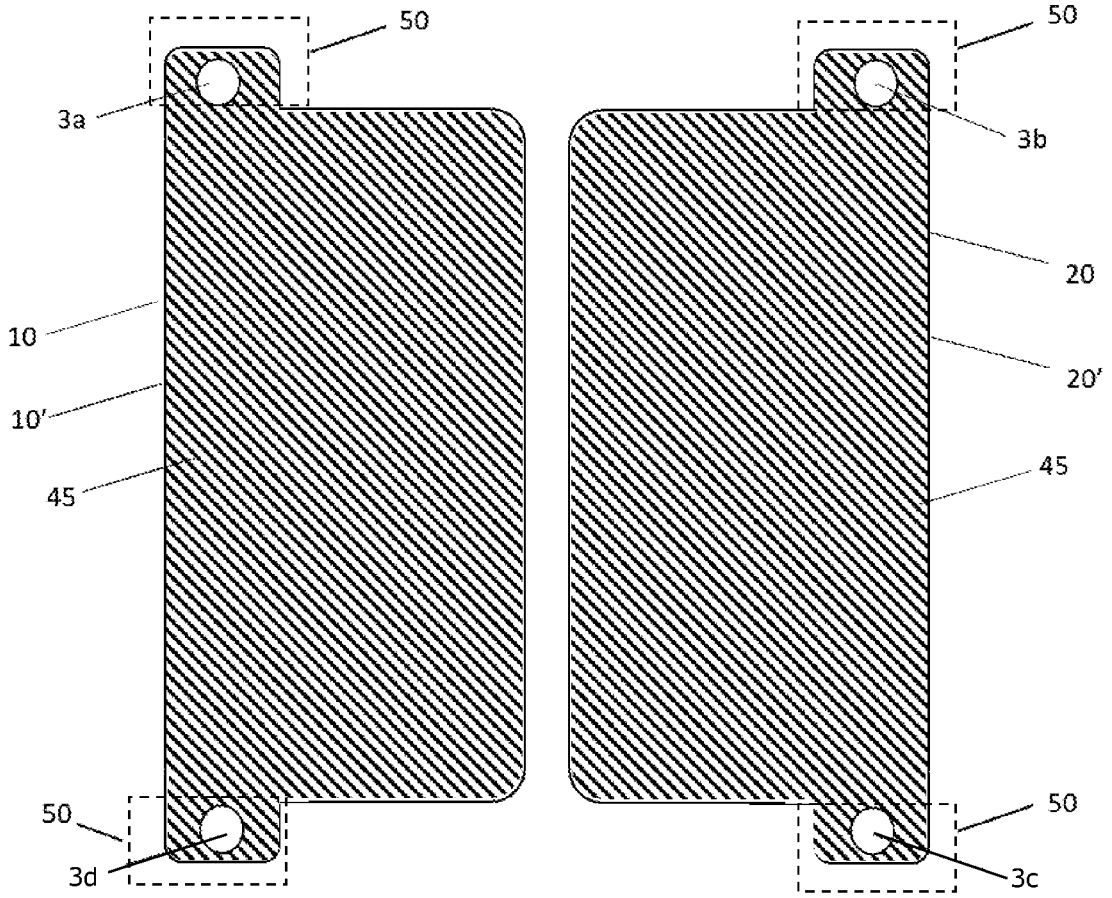
FIG. 3 is a general illustration of a first heat transfer plate and a second heat transfer plate formed with extension sections with openings according to an embodiment of the present invention.

FIG. 3 illustrates an embodiment solution where a first heat transfer plate 10 is formed with extension sections 50 reaching out of the main part of the heat transfer plate 10. The openings of a first set of openings 3*a*, 3*d* are formed in the extension sections 50.

In the illustrated embodiment an extension section 50 comprising one of the first set openings 3*a* is formed at the one end of the first heat transfer plate 10, and the other of the first set openings 3*d* is formed at the opposite end of the first heat transfer plate 10. The two extension sections 50 may be positioned directly opposite each other along a line parallel to the long edge of the first heat transfer plate 10, and thereby of a heat exchanger in which the first heat transfer plate 10 is arranged. In another embodiment the extension sections 50 may be positioned diagonally with respect to each other, e.g. at diagonally opposite corners of the first heat transfer plate 10, i.e. the opposite corners corresponding to the corners crossed by a diagonal of the first heat transfer plate 10. In a more general embodiment, they may be positioned at any position at the short edge or the long edge of the first heat transfer plate 10.

The second heat transfer plate 20 is very similar the first heat transfer plate 10, and it is formed in a similar manner, in the sense that a second set of openings 3*b*, 3*c* are formed in extension sections 50. In the illustrated embodiment an extension section 50 comprising one of the second set openings 3*b* is formed at the one end of the second heat transfer plate 20, and the other of the second set openings 3*c* is formed at the opposite end of the second heat transfer plate 20. Similarly to what is described above with reference to the first heat transfer plate 10, the two extension sections 50 of the second heat transfer plate 20 may be positioned directly opposite each other along a line parallel to the long edge of the second heat transfer plate 20, diagonally, or at any position at the short edge or the long edge of the second heat transfer plate 20.

Figure 4:
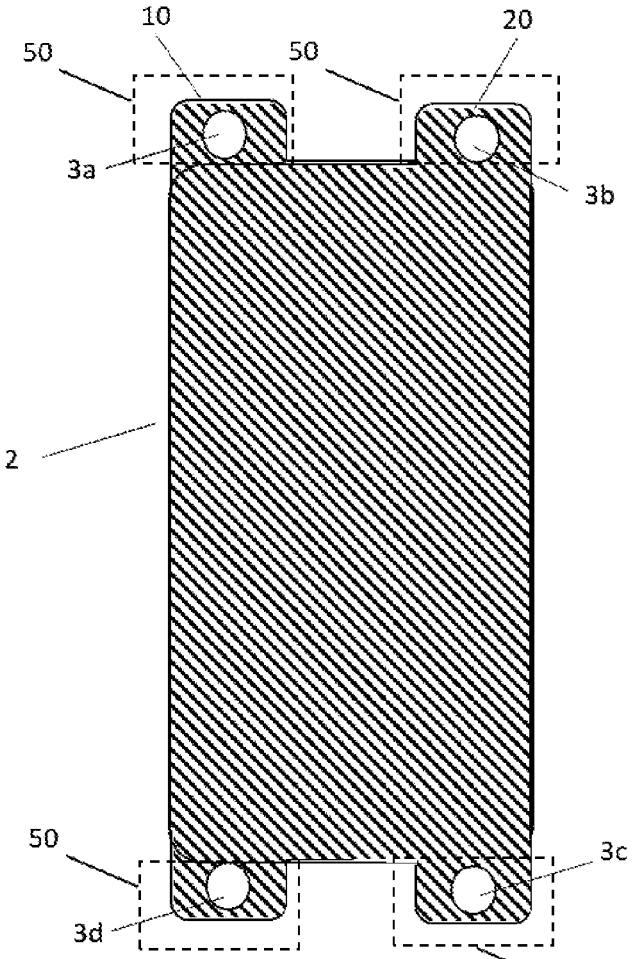
FIG. 4 is a general illustration of a plate element formed of a first heat transfer plate and a second heat transfer plate formed with extension sections with openings according to an embodiment of the present invention.

The extension sections 50 of the first heat transfer plate 10 and the extension sections 50 of the second heat transfer plate 20 are positioned such that when the first heat transfer plate 10 and the second heat transfer plate 20 are positioned adjacent to each other with matching main parts, the extension sections 50, or at least the respective openings 3*a*, 3*b*, 3*c*, 3*d*, of the respective heat transfer plates 10, 20, are free from each other or are not contacting/overlapping. This is also illustrated in FIG. 4.

In general, the extension sections 50 may be formed with surface patterns 45 adapted to connect to surface patterns 45 of extension sections 50 of neighbouring plate elements 2 when stacked into a heat exchanger 1, and may thus form a minor part of the heat exchanging portion 40.

The extended sections 50 may also be formed with surface patterns adapted to distribute the fluid to the entire width of the plate element 2, and/or similarly to feed it to an opening 3*a*, 3*b*, 3*c*, 3*d* from the heat exchanging portion 40.

The main part of the heat transfer plate 10, 20 may be of a regular shape, such as substantially rectangular, oval, pentagonal, hexagonal, etc., where the extension sections 50 form 'ears' to the regular shape, or more generally, reach or protrude out from the regular shape.

The first heat transfer plate 10 and the second heat transfer plate 20, with their respective extension sections 50, may be formed such that when connected into a plate element 2 they appear as a single plate, possible having a combined shape and size similar to that of a standard plate element 2 as known in the prior art. Together they may be substantially rectangular (possible with rounded corners), or having another more regular shape. This is also reflected in that, even though each of the first heat transfer plate 10 and the second heat transfer plate 20 only comprises one set of openings, such as the first heat transfer plate 10 being formed with the first set of openings 3*a*, 3*d* and the second heat transfer plate 20 being formed with the second set of openings 3*b*, 3*c*, when combined into a plate element 2, the plate element 2 comprises the first set of openings 3*a*, 3*d* as well as the second set of openings 3*b*, 3*c*.

In general, the plate elements 2 may be adapted to function as general heat transfer plates of known single and double kind plate heat exchangers 1.

Figure 5:
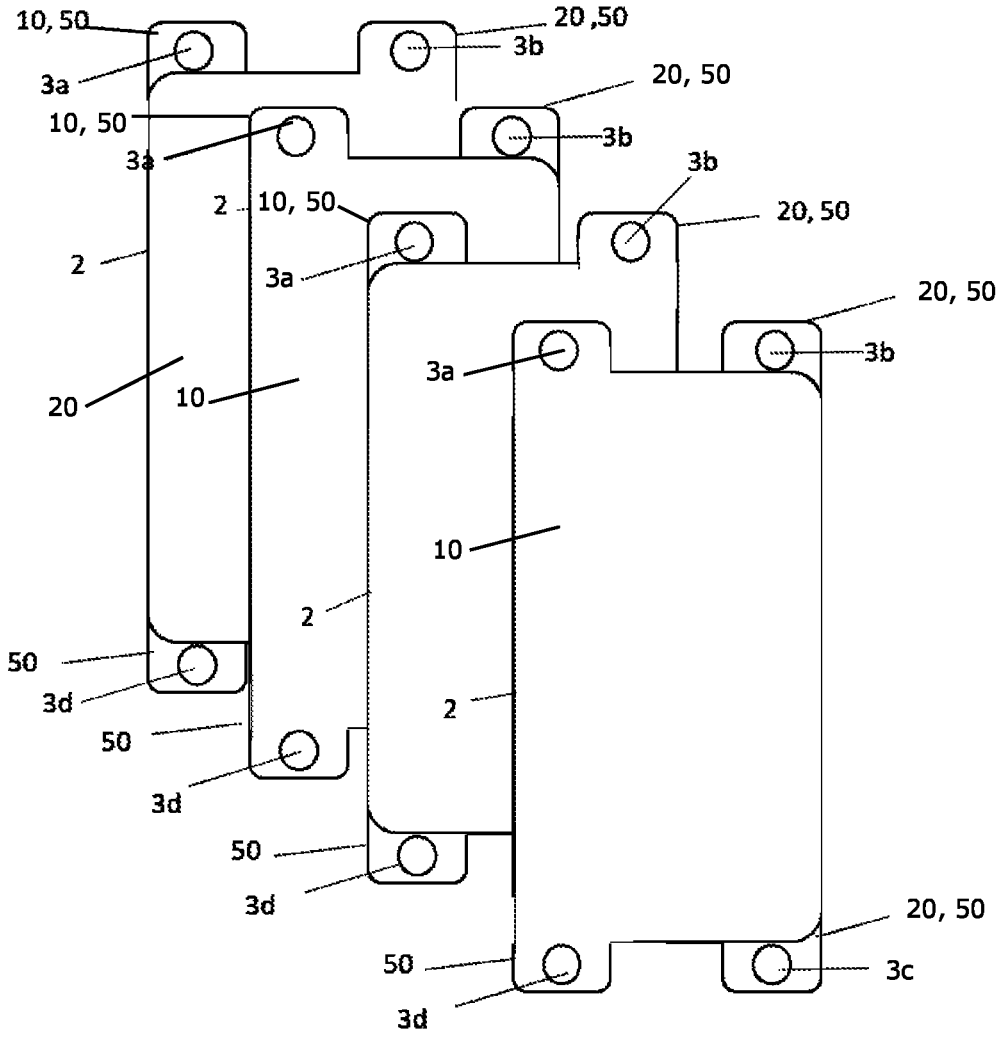
FIG. 5 is a general illustration of four plate elements formed of a first heat transfer plate and a second heat transfer plate formed with extension sections with openings according to an embodiment of the present invention and adapted to be stacked into a heat exchanger.

FIG. 5 illustrates four plate elements 2 to be positioned on top of each other for a plate heat exchanger 1, each formed of a first heat transfer plate 10 and a second heat transfer plate 20, showing the extension sections 50, each formed with an opening 3*a*, 3*b*, 3*c*, 3*d*.

In the illustrated embodiment the plate elements 2 are connected such that a first heat transfer plate 10 of a given plate element 2 connects to a first heat transfer plate 10 of one neighbouring plate element 2, and the second heat transfer plate 20 of the given plate element 2 connects to a second heat transfer plate 20 of the other neighbouring plate element 2. The extension sections 50 of the first heat transfer plates 10 are positioned such that the respective first set of openings 3*a*, 3*d* of a plate element 2 are aligned with the respective first set of openings 3*a*, 3*d* of the neighbouring plate elements 2. Correspondingly, the extension sections 50 of the second heat transfer plates 20 are positioned such that the respective second set of openings 3*b*, 3*c* of a plate element 2 are aligned with the respective second set of openings 3*b*, 3*c* of the neighbouring plate elements 2.

The neighbouring plate elements 2 may be fixed, or at least sealed, along the rims 10', 20' of the connected heat transfer plates 10, 20.

Figure 6A:
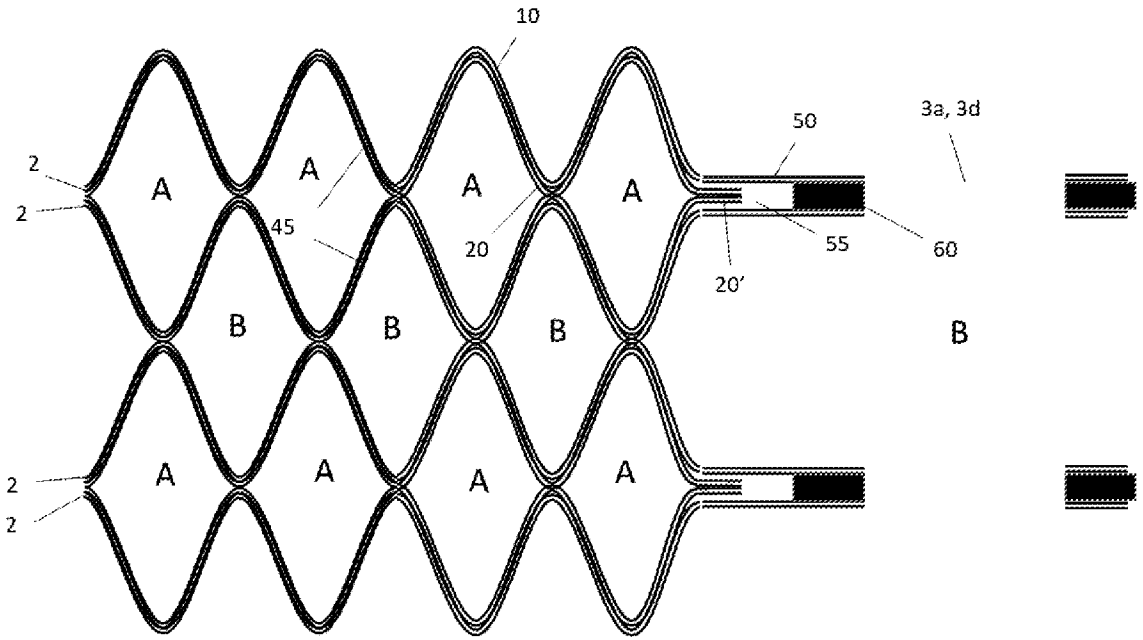
FIGS. 6A and 6B are general illustrations of four plate elements stacked into a heat exchanger showing the extension sections.
Figure 6B:
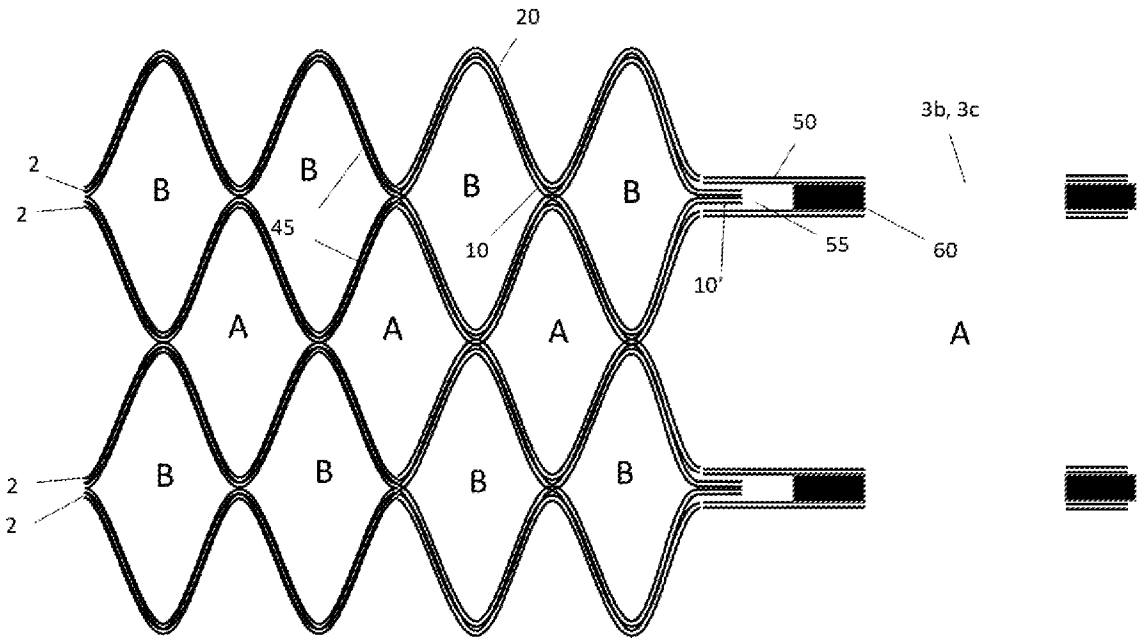

FIGS. 6A and 6B illustrate the respective extension sections 50 of four plate elements 2, where FIG. 6A shows the extension sections 50 of the first heat transfer plates 10, and FIG. 6B shows the extension sections 50 of the second heat transfer plates 20.

Seen in FIG. 6A is the connected second heat transfer plates 20 not reaching the extension sections 50 of the first heat transfer plates 10 with the openings 3*a*, 3*d*. In the same manner, in FIG. 6B the connected first heat transfer plates 10 are seen not reaching the openings 3*b*, 3*d*, and not reaching the extension portions 50 of the second heat transfer plates 20.

This construction ensures that no path is formed within the plate elements 2 between the first heat transfer plate 10 and the second heat transfer plate 20 to the respective openings 3*a*, 3*b*, 3*c*, 3*d*. A fluid leaking, for some reason, into the area between first heat transfer plate 10 and the second heat transfer plate 20 of the plate element 2 will not have contact to the openings 3*a*, 3*b*, 3*c*, 3*d*, but would either be sealed within the area or leak out at the edges.

As illustrated, the connected first heat transfer plates 10 and the connected second heat transfer plates 20 are sealed 60 at the circumference of the respective openings 3*a*, 3*b*, 3*c*, 3*d*, separating them from the inner 55 of the connected extension sections 50. In this embodiment, the connected rims 20' of the second heat transfer plates 20 are sandwiched between two first heat transfer plates 10 (of the respective and the neighbouring plate element 2).

Leaking fluid entering the volume between the two heat transfer plates 10, 20 of the neighbouring plate elements 2, thus, would leak to the inner 55 rather than into the openings 3*a*, 3*b*, 3*c*, 3*d*.

The connected extension sections 50 may be open at their rims, e.g. formed with drain openings, allowing the fluid leaking into the inner 55 to exit the heat exchanger 1 to be detected.

In general, the openings 3*a*, 3*b*, 3*c*, 3*d* are known to form weak areas, in terms of risk of leaking, since this is the areas of the highest pressure differences. The construction according to the present invention prevent mixing of the fluids at the openings 3*a*, 3*b*, 3*c*, 3*d*. The invention further enables the use of substantially thin heat transfer plates 10, 20, even for high pressure systems, since a deforming or cracking heat transfer plate 10, 20 would not leak to the openings 3*a*, 3*b*, 3*c*, 3*d* of the other of the flow paths A, B, since they are separated.

Often two distinct heat exchangers are used, the present invention allows the use of a single heat exchanger.

While the present disclosure has been illustrated and described with respect to a particular embodiment thereof, it should be appreciated by those of ordinary skill in the art that various modifications to this disclosure may be made without departing from the spirit and scope of the present disclosure.

The invention claimed is:

1. A plate element comprising a first heat transfer plate and a second heat transfer plate, the first heat transfer plate and the second heat transfer plate being connected to each other to form the plate element, each of the first heat transfer plate and the second heat transfer plate being formed of a plate body with a main part with a heat exchanging portion formed with a surface pattern, wherein the first heat transfer plate is formed with a first set of openings in first extension sections reaching out from the main part of the plate body, and the second heat transfer plate is formed with a second set of openings in second extension sections reaching out from the main part of the plate body, wherein the first extension sections of the first heat transfer plate and the second extension sections of the second heat transfer plate are positioned such that the first set of openings and the second set of openings are not overlapping, wherein the first heat transfer plate and the second heat transfer plate are identical, each of the first heat transfer plate and each of the second heat transfer plate being formed of a single solid plate, and wherein each of the first and second heat transfer plates has no more than two openings.

2. The plate element according to claim 1, wherein the surface patterns of the respective first heat transfer plate and second heat transfer plate are formed such that they match each other, such that the surface pattern of one plate fits into the surface pattern of the other plate, thereby together appearing as a single surface pattern of the plate element.

3. The plate element according to claim 1, wherein the second heat transfer plate is rotated 180° relative to the first heat transfer plate.

4. The plate element according to claim 1, wherein one of the first set of openings is formed in one of the first extension sections arranged at a top of the first heat transfer plate, and the other of the first set of openings is formed in the other of the first extension sections arranged at another, oppositely arranged, end of the first heat transfer plate.

5. The plate element according to claim 4, wherein the oppositely arranged extension sections of the first heat transfer plate are positioned directly opposite each other along a line being parallel to the long edge of the first heat transfer plate.

6. The plate element according to claim 4, wherein the oppositely arranged extension sections of the first heat transfer plate are positioned at diagonally opposite corners of the first heat transfer plate.

7. The plate element according to claim 1, wherein one of the second set of openings is formed in one of the second extension sections arranged at one end of the second heat transfer plate, and the other of the second set of openings is formed in the other of the second extension sections arranged at another, oppositely arranged, end of the second heat transfer plate.

8. The plate element according to claim 7, wherein the oppositely arranged extension sections of the second heat transfer plate are positioned directly opposite each other along a line being parallel to the long edge of the second heat transfer plate.

9. The plate element according to claim 7, wherein the oppositely arranged extension sections of the second heat transfer plate are positioned at diagonally opposite corners of the second heat transfer plate.

10. The plate element according to claim 1, wherein the first heat transfer plate is made from a first material, and the second heat transfer plate is made from a second material, wherein the second material differs from the first material.

11. The plate element according to claim 10, wherein the first material is a metal and the second material is a plastic material.

12. A heat exchanger comprising two or more stacked plate elements according to claim 1, thereby forming a first flow path (A) along one side of a given plate element and along a connected first neighbouring plate element, between an inlet of the first set of openings and an outlet of the first set of openings, and forming a second flow path (B) along an opposite side of the plate element and along a connected second neighbouring plate element, between an inlet of the second set of openings and an outlet of the second set of openings.

13. The heat exchanger according to claim 12, wherein the plate elements are stacked in such a manner that the first heat transfer plate of a given plate element is arranged adjacent to the first heat transfer plate of a first neighbouring plate element, and the second heat transfer plate of the given plate element is arranged adjacent to the second heat transfer plate of a second neighbouring plate element.

14. The heat exchanger according to claim 12, wherein the plate elements are stacked in such a manner that connecting rims of the second heat transfer plates of the plate elements are sandwiched between portions of two first heat transfer plates of the plate elements, the portions of the two first heat transfer plates facing an inner volume formed between the extension sections of the two first heat transfer plates.

15. The heat exchanger according to claim 12, wherein the plate elements are stacked in such a manner that connecting rims of the first heat transfer plates of the plate elements are sandwiched between portions of two second heat transfer plates of the plate elements, the portions of the two second heat transfer plates facing an inner volume formed between the extension sections of the two second heat transfer plates.

16. The heat exchanger according to claim 14, wherein connected first heat transfer plates and connected second heat transfer plates of neighbouring plate elements are sealed at the circumference of the respective openings, thereby separating the respective openings from the inner volume formed between the respective extension sections of the heat transfer plates.

17. The heat exchanger according to claim 12, wherein the extension sections of the first heat transfer plates of the plate elements are positioned such that the respective first sets of openings are aligned, and the extension sections of the second heat transfer plates of the plate elements are positioned such that the respective second sets of openings are aligned.

* * * * *